United States Patent [19]

Justus et al.

[11] 3,990,648

[45] Nov. 9, 1976

[54] CABLE MEANS FOR CONTROLLING INTERNAL TENSION IN WEB ROLLS, AND METHOD

[75] Inventors: Edgar J. Justus; Loyal H. Hess, both of Beloit, Wis.

[73] Assignee: Beloit Corporation, Beloit, Mich.

[22] Filed: Nov. 13, 1975

[21] Appl. No.: 631,441

[52] U.S. Cl. ..... 242/66

[51] Int. Cl.[2] ..... B65H 17/08

[58] Field of Search ..... 242/66, 65, 67.1 R, 242/38.6, 75.46, 75

[56] References Cited

UNITED STATES PATENTS

| | | | |
|---|---|---|---|
| 1,870,224 | 8/1932 | Berry | 242/66 |
| 3,232,549 | 2/1966 | Stambough | 242/66 |
| 3,599,889 | 8/1971 | Pfeiffer | 242/66 |
| 3,604,649 | 9/1971 | Dorfel | 242/66 |
| 3,937,410 | 2/1976 | Justus | 242/66 |

*Primary Examiner*—Edward J. McCarthy
*Attorney, Agent, or Firm*—Hill, Gross, Simpson, Van Santen, Steadman, Chiara & Simpson

[57] ABSTRACT

Cable means are provided for controlling internal tension in web rolls during winding thereof onto cores with the aid of winding drums. According to the method of utilizing cable means for this purpose, the web rolls are partially wound between the winding drums and a rider roll, the rider roll being backed off from the web rolls after they have attained partial diameter, and during continuation of the winding of the web rolls to full diameter the load-relieving lift is applied to the web rolls through their cores by the cable means.

22 Claims, 5 Drawing Figures

Fig. 2
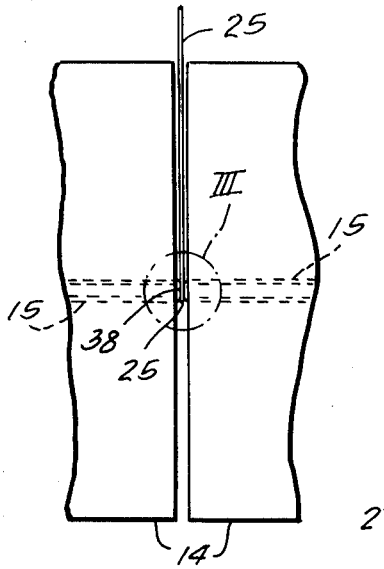
Fig. 3
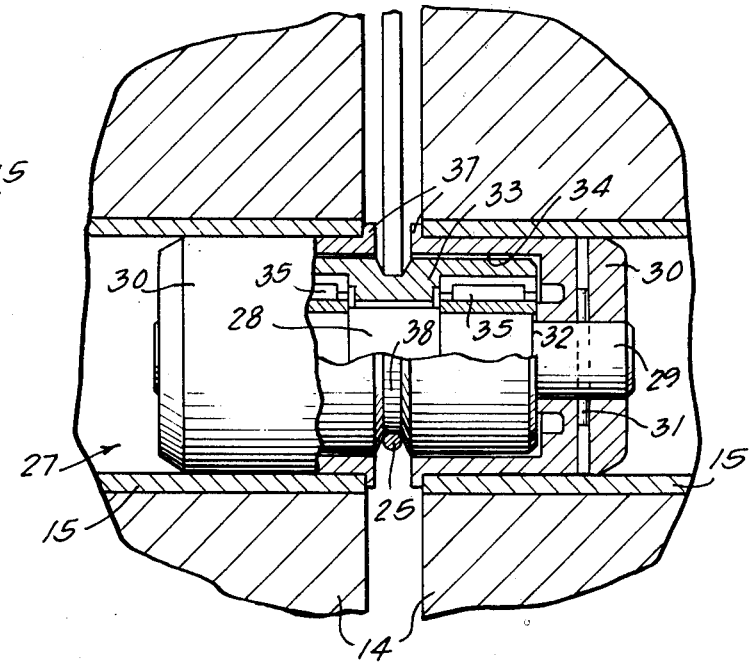
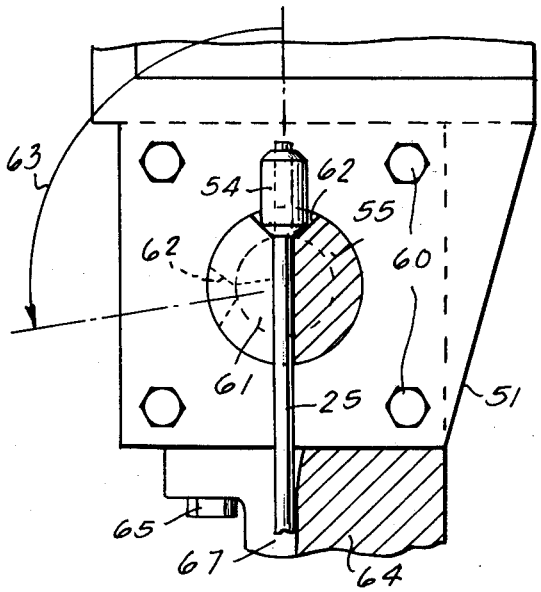
Fig. 5
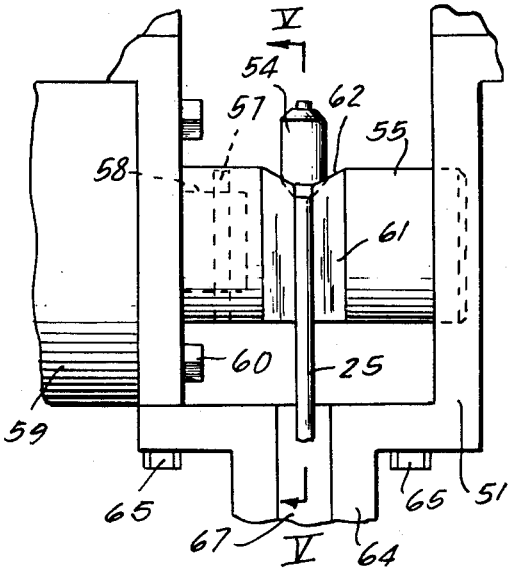
Fig. 4

CABLE MEANS FOR CONTROLLING INTERNAL TENSION IN WEB ROLLS, AND METHOD

This invention relates to the art of winding web rolls, more particularly paper rolls, and is especially directed to improving the quality of paper rolls of large diameter.

Rolls of sheet or web material, and more particularly paper, are commonly wound in a winder comprising a pair of winding drums which drive the web rolls under a variable position rider roll controlling the pressure in the nips between the winding drums and the web roll in order to control compactness of the web rolls. The rider roll is gradually eased from the web rolls as the web rolls increase in diameter and weight because the increasing weight of the web rolls contributes to maintaining adequate tension in the nips. After the size of the rolls has developed a calculable weight, however, there is increasing tension to the extent that unless great care is exercised internal forces may develop in the roll causing breaks at weaker areas of the web. Various and sundry web tensioning devices have been proposed to alleviate this problem. Such devices have generally required sophisticated tension monitoring and control systems which are costly to install and to maintain and require relatively careful and accurate adjustments for optimum results.

In the copending application of one of the applicant's herein, Ser. No. 541,505, filed Jan. 16, 1975, U.S. Pat. No. 3,937,410 and assigned to the same assignee as the present application, a new and improved method of and means for controlling internal tension in web rolls has been disclosed and said patent fairly broadly covers winding adajacent strips of a web onto adjacent rolls on a common axis and applying a vertical support force to the axis between the rolls by engagement with the axis between the rolls by a support means which applies a vertical force preventing downward deflection of the axis so that the rolls remain parallel and interference therebetween is avoided, the force applied increasing proportionately to the size and weight of the rolls. According to that patent, the means for this purpose comprise a generally vertically swinging lifting device including a lifting arm having a hook terminal portion engagable with shaft adapter means between the ends of adjacent rolls, means for lifting and lowering the device and means for swinging the device into and out of the roll-lifting relation.

An important object of the present invention is to provide a new and improved method of and means for accomplishing the same purpose, but employing a cable device for applying load-relieving lift to the web rolls through their cores and preventing downward deflection of the roll axis.

To this end, controlling of internal lineal tension in web rolls during winding thereof about core means with the aid of winding drums comprises looping a force-relieving cable under coupling means between connected adjacent roll-receiving sections of the core means, partially winding the web rolls between nips at the winding drums and a rider roll which acts through the web rolls to provide controlled tensioning load to said nips until the weight of the web rolls themselves provides sufficient self-loading of the nips for lineal tensioning of the webs in the rolls, then releasing the rider roll from the web rolls, and during continuation of winding of web rolls to full desired diameter applying load-relieving lift to the web rolls by tensioning the cable and thereby maintaining the web tensioning load at said nips at substanially optimum value as web load weight increases. The vertical force applied by the cable means prevents downward deflection of the core means sections relative to one another, thereby preventing interference between adjacent rolls.

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which FIG. 1 is a schematic side elevational view of a winder embodying features of the invention;

FIG. 2 is a fragmentary elevational view taken substantially in the plane of line II—II of FIG. 1;

FIG. 3 is an enlarged vertical sectional detail view taken substantially in the area III of FIG. 2;

FIG. 4 is an enlarged fragmentary elevational view taken substantially in the plane of line IV—IV of FIG. 1; and FIG. 5 is a sectional elevational detail view taken substantially along the line V—V of FIG. 4;

Figure 1:
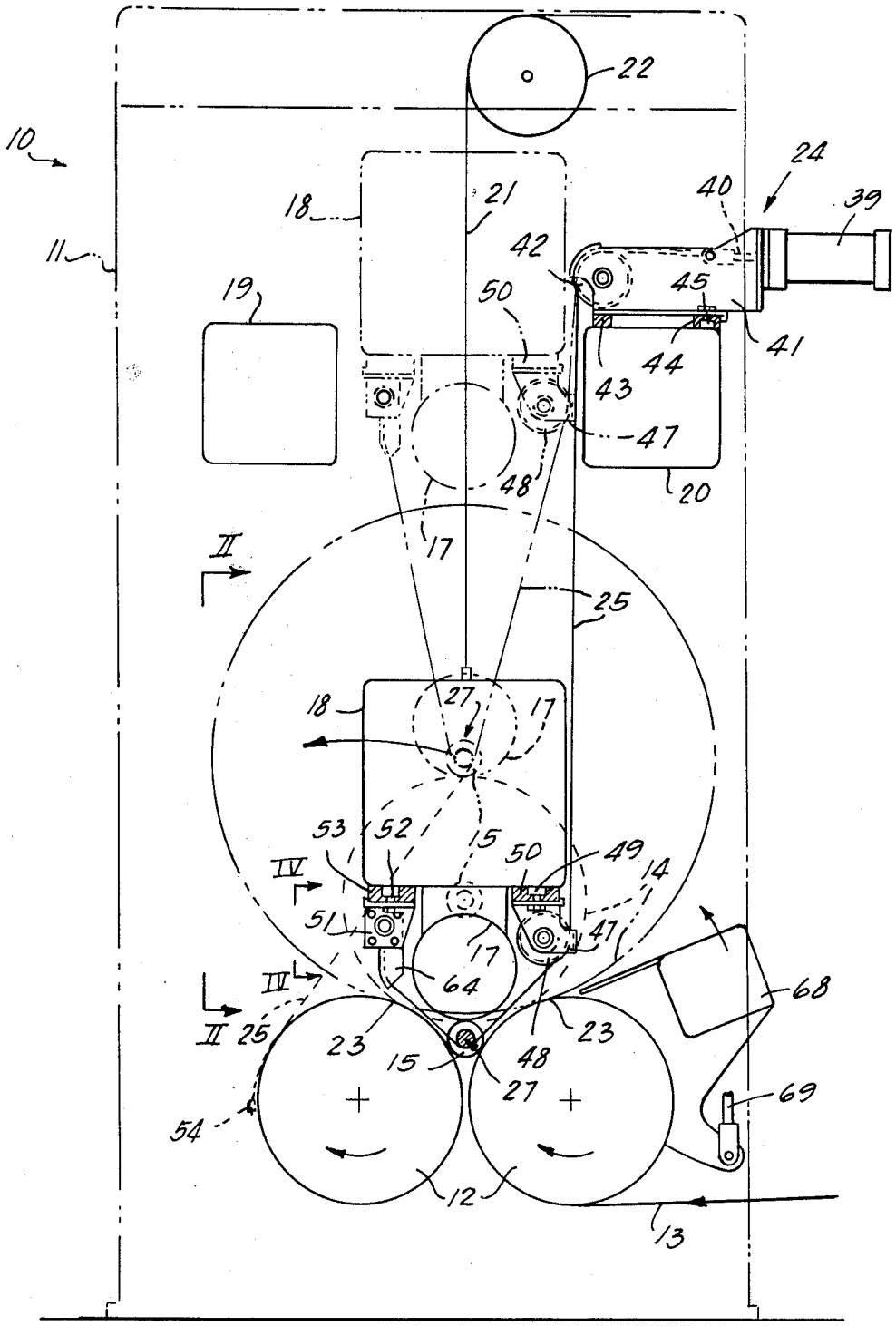

On reference to FIG. 1, winder 10 is depicted schematically comprising a supporting frame 11 within which is supported a pair of winding rolls or drums 12 suitably driven in a common direction of rotation as indicated, on parallel axes disposed in a horizonal plane and with the adjacent perimeters of the winding rolls spaced apart at least far enough to pass freely a web 13 of material such as paper delivered from a suitable source such as a reel or paper making machine (not shown) and traveling under and about one of the drums 12 to be wound by the winding drums into one or more tightly wound web rolls 14. In a preferred arrangement, a plurality of the web rolls 14 are adapted to be wound simultaneously in the winder 10 from a source web of ample width for the purpose slit before reaching the winder 10 by any suitable slitting apparatus (not shown) to provide the length of rolls desired. Newsprint rolls may range in length from ten inches to forty inches and the winder may be from 300 to 400 inches wide to permit a maximum number of rolls to be wound in each winding operation. In the winder 10, it is desirable according to the present invention to wind the rolls up to 60 to 72 inches in diameter.

As the start of a winding operation, the web strips are attached at their starting ends to tubular cores 15 (FIGS. 1, 2 and 3) placed initially in the trough opening upwardly between the winding drums 12. A rider roll 17 is moved down onto the cores 15 to apply nip pressure of the cores 15 against the winding drums 12 sufficient to assure non-slip driving of the cores 15 and the developing web rolls 14 in the relatively high speed rotation of the winding drums 12. Pressure loading of the rider roll 17 is suitably maintained by means including a rider roll beam 18 which is suitably guided for vertical travel between a pair of horizontal spaced frame beams 19 and 20. Suitable means for controlling raising and lowering of the rider roll beam 18 include cable means 21 trained over pulley means 22 mounted in the upper portion of the frame 11, and suitable driving and control means (not shown) and which may be of a type known for this purpose, a representative example of which may be found in U.S. Pat. No. 3,232,549.

Continuously as each of the web rolls 14 is wound, pressure at the nips 23 with the winding drums 12 must maintained to assure tight winding of the web sheet in the roll. However, as the roll gets bigger and heavier the weight of the roll causes the nips 23 to get bigger, which, if unrelieved, progressively increases tension in the wound web as the size of roll increases until the rupture point is reached. Up to a certain weight nip pressure relief is obtained by gradually decreasing the load of the rider roll 17 from an initial maximum pressure load at the start of the winding operation, to a zero load relationship at the point at which the weight of the web roll 14 is sufficient to maintain adequate nip pressure of its own dead weight. For example, with newsprint a web roll diameter of about 30 inches attains a self-loading weight at the nips 23 sufficient to maintain a desired web tension. Therefore, as the size of roll gradually increases from core diameter to the 30 inch diameter, the rider roll pressure load is progressively reduced to compensate for the increasinng web roll weight. However, beyond the 30 inch diameter, the increasing web roll weight progressively builds up the load at the nips 23, with indentation of the winding drum perimeter into the web roll as the weight increases with consequent rapid buildup of lineal tension in the sheet and development of damaging internal tension in the web roll.

According to the present invention, after the web roll 14 has reached a size in the winding operation where the roll weight equals the desired tensioning load at the nips 23, so that the rider roll 17 is released rom loading the web roll, continuous high speed winding of the web roll to a desired maximum size, that is full diameter, is continued while achieving a substantially optimum lineal web tension as a continuation of the web tension attained by aid of the rider roll in the first stage of web roll winding. This desirable result is attained by applying load relief lifting to the web rolls 14 through their cores 15. For this purpose, the winder 10 is provided with means comprising lifter devices 24 constructed and arranged to apply load-relieving lift to the web rolls 14 through the cores 15.

Each of the lifter devices 24 is constructed and arranged to be capable of applying lift to the outer ends of the endmost of the web rolls 14 in an aligned series and also to the adjacent ends of the contiguous rolls in the series. Desirably all of the lifters are of a standardized construction and therefore description of one of the lifter devices 24 will suffice for all that may be employed in the winder 10 regardless of its size.

In a preferred form, the lifter devices comprise respective flexible tension elements 25, referred to herein for sake of brevity as cables. Each of the cables 25 is arranged to be looped in lifting relation under a suitable coupling device 27 (FIG. 1, 2 and 3) connecting the adjacent ends of the tubular cores 15 of the rolls to be lifted.

In one perferred form, the coupling devices 27 comprise cable-engageable shaft adapter means including a stub shaft 28 of stepped construction toward each end from a center portion providing reduced diameter end sections 29 on which are mounted fixed bevel ended plugs 30 secured as by means of pins 31 and against respective locating shoulders 32. A tubular rider sleeve 33 bridges between the plugs 30 in respective recesses 34, roller bearings 35 providing for substantially friction free rotation of the sleeve 33 about the shaft 28 in each instance. Radial stop flanges 37 on the inner ends of the plugs 30 engage the contigous ends of the cores 15 and thereby maintain them in suitable spaced relation. An annular centered groove 38 in the outer periphery of the sleeve 33 is provided to receive the looped cable 25.

At the start of a winding operation cycle, suitable lengths of the cores 15 are placed in the trough of the winding rolls 12 and coupled together in end-to-end relation by means of the shaft adapter plug assemblies 27, with one of the adapter assemblies 27, plugged into each opposite end of the core assembly. Assemblying of the core sections 15 and the adapters 27 may be effected directly in the winding roll trough, or the entire length of core sections 15 and adapters 27 may be pre-assembled and placed in the winding roll trough to conserve down time between winding cycles. The latter procedure would be preferred where the winder 10 is on-stream relation to a paper making machine, but would not be as important where the winder 10 is merely in receiving relation to a web reel supply station.

Then the leading ends of the desired width of the webs are attached to the core sections 15 and with the rider roll 17 pressing down against the cores 15 with adequate winding pressure, the winding operation proceeds by powered rotation of the winding drums 12. As winding of the web roll 14 on each of the cores 15 proceeds, the rider roll 17 maintains progressively slackening roll winding pressure as the web roll diameter and thus weight increases until the web roll weight itself provides the proper pressure at the nips 23 for uniform lineal web tension during winding. The rider roll 17 then backs off and maintains a slightly spaced position relative to the perimeter of the expanding web roll 14, serving then as merely a safety restraint against any possible tendency for the web roll 14 to displace from the winding rolls 12 during high speed winding.

Until the web roll winding progresses to zero pressure demand from the rider roll 17, each of the lifter devices 24 remains inactive. Prior to start of a winding operation, each of the lifter devices 24 is properly oriented with respect to the length of web rolls to be accomodated, that is one each of the lifter devices 24 is located at the respective opposite ends of the string of coupled cores whereby to be selectively engageable with the respective shaft adapters 27 at such ends, and others of the lifter devices 24 are positioned for selective engagement with each of the shaft adapters 27 between the several core sections.

In a preferred construction, one end of the cable is coupled to cable tension controlling means in the form of a pressure fluid operated actuator 39 desirably of the cylinder and piston type having a piston 40. Conveniently, the actuator 39 may be mounted on the machine frame 11 as by means of a bracket 41 carried at a suitable height as for example on top of the beam 20 which extends horizontally along the back of the upper portion of the frame. From its coupling with the piston rod 40, the cable 25 extends to and runs over a pulley 42 mounted rotatablly on the bracket 41 adjacent the inner side of the beam 20 so that the cable can extend downwardly to loop under the selected core coupling adapter 27. To facilate accurate individual adjustments of the lifing devices 24 along the width of the winder 10, the means are provided for mounting the brackets 41 adjustably along the beam 20. Suitable means for this purpose comprise rails 43 and 44 in spaced parallel relation along the top of the beam 20 and on which the brackets 41 are directly supported, one of the rails such as the rail 44 being of inverted channel shape, and T-bolts 45 securing the brackets to the rail 44. By loosening the bolts 45, the brackets 41, and thereby the lifter devices 24 can be moved incrementally along the beam 20 into the desired position in alignment with the selective core couplings 27 in which the respective cables 25 are to be engaged.

From the pulley 42, each of the cables 25 extends downwardly along the adjacent side of the rider roll beam 18 and through a guide bracket 47 on the lower side of the beam 18 and provided with a guide pulley 48 which maintains the cable clear of the adjacent vertical face of the beam 18 and free from interference with the rider roll 17. Mounting of the bracket 47 in each instance to permit adjustment in alignment with the bracket 41 is effected by T-bolt means 49 for attaching the bracket 47 adjustably to complementary track means 50 carried by the beam 18. From the pulley 48, the cable 25 extends to and is looped under the selected core coupling 27, engaging in the guide groove 38 thereof. At its end remote from the actuator 39, the cable 25 is releasably attached to the beam 18 at the opposite side of the rider rolls 17 from the guide bracket 47. For this purpose, bracket means 51 are adjustably connected as by means of T-bolt means 52 to complementary rail means 53 carried by the lower side of the beam 18 on the opposite side of the rider roll 17 from and parallel to the rail 50. Thereby the bracket 51 can be adjusted in alignment with the bracket 47 and the bracket 41.

For releaseable attachment of the cable 25 to the bracket means 51, the releaseable terminal end of the cable is provided with a coupling knob or enlarged terminal member 54 (FIGS. 4 and 5) which is constructed and arranged to be selectively coupled with and released from means comprising a cable lock 55. In one desirable form, the cable lock device 55 comprises an oscillatable drum or hub rotatably supported by the bracket structure 51 and forming part of or connected as by means of a pin 57 co-rotatably on a drive shaft 58 of a rotary actuator 59 which may be of any perferred form but may suitably comprise a fluid operated actuator of the air torque type and attached as by means of screws 60 to one side of the bracket 51 with the hub 55 spanning a suitable vertical gap in the bracket. Intermediately the hub 55 has formed on its side remote from the rider roll 17, a convergently sided slot 61 receptive of the cable 25 and of a depth such that, as best seen in FIG. 5, the axis of the anchored cable 25 crosses the axis of the hub 55. At its root the transverse groove or slot 61 is generally complementary to the diameter of the cable 25. Releasable interlock between the coupling knob 54 and the hub 55 is effected by means of a coupling recess socket 62 in the hub 55 aligned with the upper end of the slot 61 and complementary to the inner or lower end of the knob and thus wider than the root of the slot 61 so that in the upright position of the interlock socket provided by the recess 60 the knob 54 will be held positively against escape from the socket under even slight tension of the cable 25. In order to release the cable from the hub 55, the hub is turned as indicated by directional arrow 63 in FIG. 5 to move the socket 62 downwardly generally toward the slot 61 until the knob 54 escapes from the socket 62. To assure positive release of the cable requiring complete ejection of the anchoring knob 54, a releasing turn of about 100° from the fully vertical position of the socket 61 is desirable where the cable 25 is under tension. Where the cable 25 is slack, it can be easily lifted to anchor the knob 54 in the upright socket 62 or even release the cable if desired.

In order to hold the looped, anchored cable 25 away from and provide ample clearance for the rider roll 17, the anchoring bracket 51 is desirably equipped with a deepening guide projection 64 which may be formed integrally with other parts of the bracket 51 or may be secured in assembly therewith as by means of screws 65. On its side remote from the rider roll 17, the guide projection 64 is desirably provided with a guide groove 67 generally aligned with the root of the slot 61 and the hub 55, and its lower end portion curved generally toward the winding trough between the winding rolls 12 so as to avoid creasing strain on the cable under tension and diverging from the guide means projection 64.

At the beginning of a winding cycle, the cable 25 of each of the lifter devices 24 is disengaged from the anchoring device bracket 51 and relaxes to lie on the winding rolls 12 and to dip down into the winding trough between the rolls. Then the aligned cores 15 are assembled in the winding trough, with the respective adapter hub assemblies 27 having the associated lifting cables 25 aligned thereunder. During this procedure, the cable actuator 39 desirably has the piston rod 40 fully extended to facilitate relaxation of the cable 25. The web ends are suitably attached to the cores 15, and the rider roll beam 18 is lowered to engage the rider roll 17 onto the cores 15 to apply nip pressure of the cores against the winding drums 12. Anchoring of the free end of the calbe 25 in each instance is now effected with its respective anchoring hub 55, and the actuator may be activated to apply anchor retaining tension to the associated cable 25. At this point in the winding cycle the relationship of apparatus is substanially as shown in full outline in FIG. 1.

As winding of the roll 14 progresses in each instance, the cable loop between the guides 47, 48 and 64 is gradually elongated substanially proportionate to rider roll 17 progress upwardly with increase in wound roll diameter during an initial phase of the winding the actuator 39 merely maintains a moderate tension on the cable 25 sufficient to maintain the anchored end against escape from the anchoring socket 62. During this first phase of winding the web roll 14 increases in size and weight to the point at which winding pressure at the nips 23 needs relief. For example, the weight at which relief is required may be attained in a newsprint paper roll at about 30 inch diameter. Thereupon, the actuator 39 is operated to increase the tension on the cable 25, thereby applying a lifting force to the cable correlated to the progressively increased diameter and wieght in web roll 14 to maintain optimum winding pressure at the nips 23. Such correlation of operation of the actuator 39 corresponds substanially to release of the rider roll 17 by backing off of the rider roll beam 18. Lifting by the cables 25 progresses proportionally as the diameter and weight of the web roll 14 increase while the cable follows the upward progress of the cores 15 of the increasing diameter web rolls as the rider roll beam 18 travels upwardly. When the web roll 14 has reached its ultimate size, such as on the order of 60 inch diameter, indicated in dot-dash outline in FIG. 1, winding is terminated by stopping the winding rolls 12. At this point the lifting force applied by actuator 39 is stopped and the hub actuator 59 is operated to turn the hub 55 and release the anchoring knob 54 so that the free end of the cable 25 drops down from the dot-dash position shown in FIG. 1, to the dash outline position so that the completed web roll 14 can be ejected from the winder 10. Any suitable means for effecting operation of the actuators 39 and 59 including electro-pneumatic circuitry, load cell means and other desirably means permitting automatic or manually controlled operation, may be provided. Such means are readily available and need therefore not be more particularly described.

Means for ejecting the completed web rolls 14 form the winder 10 comprise an ejector beam 68 which may be suitably mounted in normally clearance relation to the winding space within the winder frame 11. On completion of the web rolls 14, the ejector 68 is adapted to be actuated as by means of a suitable actuator 69 to dump the finished web rolls from the winder 10 in the direction of the indicating arrow, away from the disengaged lifter cables 25, thereby clearing the winder 10 for a repeat winding cycle.

It will be understood, of course, that all of the lifter devices 24 associated with the winder 10 are operated in unison in all phases of the winding cycle in which the lifters are employed. In the operating and control circuitry, the lifing force applied by the respective actuators 39 will be monitored and controlled for uniformity of action and lifting throughout the length of the coupled cores 15 such that the vertical force applied will prevent downward deflection of the axis at any point whereby the rolls 14 will remain parallel and coaxial and interference there between will be avoided. At the opposite ends of the series of web roll 14, the respective lifter actuators 39 will, of course be controlled to only about half the load that the actuators 39 for the lifter devices 24 located between any two adjacent web rolls will be required to lift. Such differential in lifting forces is easily attained by conventional fluid actuator controls.

From the foregoing it will be appreciated that pursuant to the present invention substantially larger web rolls can be satisfactorily wound and thus more end product tonnage provided with less downtime between winding cycles. More intensive use of winder and associated equipment is attained. Therefore significant production economies are effected.

It will be understood that variations and modifications may be effected without departing from the spirit and scope of the novel concepts of this invention.

I claim as my invention:

1. A method of controlling internal lineal tension in web rolls during winding thereof about cores with the aid of winding drums, comprising:

looping roll weight relieving cable means under coupling means attached to the ends of the cores;

partially winding the web rolls between nips at the winding drums and rider roll means which act through the web rolls to provide controlled tensioning load to said nips until the weight of the web rolls themselves provides sufficient self-loading of the nips for lineal tensioning of the webs in the rolls;

then releasing the rider roll means from the web rolls; and during continuance of winding the web rolls to full desired diameter tensioning the cables and thereby applying load-relieving lift to the web rolls through their cores to maintain the web tensioning load at said nips at a substantially optimum value as web load weight increases.

2. A method according to claim 1, comprising inserting peripherally grooved adapter means into said end portions of the web roll cores, and looping the cables in the grooves of the adapter means to apply the load-relieving lift to the adapter means.

3. A method according to claim 1, comprising proportionately increasing tension load-relieving lift force to the cables relative to progressively increasing weight of the web rolls.

4. A method according to claim 1, including at full diameter of the web rolls terminating said load-relieving lift applied through said cables, releasing the cables from the coupling means, and ejecting the web roll from said drums.

5. A method according to claim 1, comprising initially laying the cables in position into a trough provided by the winding drums and under the coupling means of the web cores, starting web material onto the cores while the rider roll applies tensioning load to the cores and the started web material toward the nips at the winding drums, and after the web rolls have reached said self-loading weight applying lifting tension force to the cables and thereby applying the load-relieving lift to the cores.

6. A method according to claim 1, wherein one end of the cables is fixed to actuating means located at one side of and at a height greater then the highest position to which the rider roll travels during a roll winding cycle, releasably anchoring the opposite ends of the looped cables to a vertically moveable rider roll carrier structure, and when the web rolls have attained the full desired diameter releasing the anchored ends of the cables and ejecting the web rolls from the winding drums and from the cables.

7. Apparatus for controlling internal lineal tensioning in web rolls during winding thereof about cores, comprising:

winding drums on which the web rolls are in nip engagement;

a rider roll which imposes lineal web tensioning load on the web rolls toward said nips until the web rolls are partially wound and the weight of the web rolls themselves provide self-loading of the nips to maintain the lineal tension;

means for releasing the rider roll from the web rolls when the web rolls have attained self-loading weight; and cable means operating during continuance of the winding of the web rolls on the drums for applying load-relieving lift to the web rolls through their cores to maintain the web tensioning load at said nips at a substantially optimum value until the web rolls have attained full sized diameter and weight.

8. Apparatus according to claim 7, including shaft adapter means to be inserted into end portions of the web roll cores, said cable means being applied to said shaft adapter means to effect the load relieving lift.

9. Apparatus according to claim 7, including means for tensioning the cable means to proportionately increase the lifting force relative to progressively increasing weight of the web rolls during winding.

10. Apparatus according to claim 7, wherein said cable means are arranged to terminate load relieving lift and to be released when the web rolls have attained full diameter, and means for ejecting the full diameter web rolls from said drums.

11. Apparatus according to claim 7, comprising core shaft means connecting the cores so that the cores can be initially laid into a trough provided by the winding drums and the web material started onto the cores while the rider roll applies tensioning load to the cores and the started web material toward the nips at the winding drums, and said cable means being looped under said core shaft means and including means operable after the web rolls have reached a self-loading weight for applying load relieving tension the cables and thereby lift to the cores through said shaft means.

12. Apparatus according to claim 7, wherein said cable means comprise a generally vertically movable device having the cable means attached to means vertically moveable with said rider roll, and means for operating said device to tension the cable means.

13. Apparatus according to claim 12, wherein said operating means comprise actuator means for applying tension to the cable means in a generally upward direction.

14. Apparatus according to claim 7, including tension applying means attached to one end of the cable means, and releaseable anchoring means to which the opposite end of the cable means are attached.

15. Apparatus according to claim 12, wherein said operating means include a pressure fluid actuator attached to one end of the cable means.

16. Apparatus according to claim 12, including adapter shaft means for engagement in the end portions of the web roll cores and having engagement areas thereof exposed at the ends of the cores, and said cable means engageable selectively in lifing relation with the engagement area of one of the adapter shaft means.

17. Apparatus according to claim 12, including means for effecting adjustments of the lifting device to accommodate variable lenghts of web rolls.

18. A winder apparatus for simultaneously winding a slit web onto a plurality of adjacent rolls on a common axis comprising in combination:

axially extending shaft means for core means for receiving a plurality of webs and winding them onto a plurality of rolls;

and cable means engageable with the shaft means between adjacent rolls for applying a vertical force thereto preventing downward deflection of the shaft means and preventing interference between adjacent rolls due to downward deflection of the axis.

19. A winder apparatus for simultaneously winding a slit web onto a plurality of adjacent rolls on a common axis constructed in accordance with claim 17, wherein said cable means are looped under tension around shaft means between the ends of the rolls.

20. A winder apparatus for simultaneously winding a slit web onto a plurality of adjacent rolls on a common axis constructed in accordance with claim 17, including a tension force applying means connected to said cable means operative to apply a variable lifting force increasing with the diameter and weight of the rolls.

21. The method of winding a slit web into a plurality of adjacent rolls on a common axis comprising the steps:

winding adjacent strips of a web onto adjacent rolls on a common axis;

and applying a vertical support force to the axis between the rolls by engagement with the axis between the rolls by a suspension cable means applying a vertical force preventing downward deflection of the axis so that the rolls remain parallel and interference therebetween is avoided.

22. The method of winding a slit web into a plurality of adjacent rolls on a common axis in accordance with the steps of claim 21, comprising increasing lifting force applied through the cable means proportionately to increase in the size and weight of the rolls as winding of the rolls progresses.

* * * * *